US010954873B2

(12) United States Patent
Shrestha et al.

(10) Patent No.: US 10,954,873 B2
(45) Date of Patent: Mar. 23, 2021

(54) ENGINE LAMBDA DYNAMIC CONTROL STRATEGY FOR EXHAUST EMISSION REDUCTION

(71) Applicants: Amit Shrestha, Rochester Hills, MI (US); Bei Jin, Rochester Hills, MI (US); Jingjing Li, Troy, MI (US); Fadi Estefanous, Troy, MI (US); Lurun Zhong, Troy, MI (US); Singalandapuram Mahedevan Boopathi, Ann Arbor, MI (US); Mitchell Ober, Northville, MI (US)

(72) Inventors: Amit Shrestha, Rochester Hills, MI (US); Bei Jin, Rochester Hills, MI (US); Jingjing Li, Troy, MI (US); Fadi Estefanous, Troy, MI (US); Lurun Zhong, Troy, MI (US); Singalandapuram Mahedevan Boopathi, Ann Arbor, MI (US); Mitchell Ober, Northville, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 16/290,365

(22) Filed: Mar. 1, 2019

(65) Prior Publication Data

US 2020/0277911 A1 Sep. 3, 2020

(51) Int. Cl.
*F02D 41/14* (2006.01)

(52) U.S. Cl.
CPC ..... *F02D 41/1454* (2013.01); *F02D 41/1441* (2013.01); *F02D 2250/36* (2013.01)

(58) Field of Classification Search
CPC ..... F02D 41/1408; F02D 41/1441; F02D 41/1454; F02D 41/1475
See application file for complete search history.

(56) References Cited

U.S. PATENT DOCUMENTS 5,622,047 A * 4/1997 Yamashita ..... F01N 11/007 60/274
5,842,340 A 12/1998 Bush et al.
6,267,937 B1 * 7/2001 Ma ..... B01D 53/9454 423/213.2
6,993,901 B2 2/2006 Shirakawa
7,577,511 B1 8/2009 Tripathi et al.
(Continued)

*Primary Examiner* — Sizo B Vilakazi
*Assistant Examiner* — Anthony L Bacon
(74) *Attorney, Agent, or Firm* — Ralph E Smith

(57) ABSTRACT

An emissions control system for a vehicle having an exhaust system with an exhaust gas conduit and a catalytic converter configured to receive exhaust gas from an engine is provided. In one example implementation, the system includes an engine controller configured to control the engine to adjust an air to fuel ratio (lambda) thereof. The engine controller is configured to operate the engine with at least one of the following lambda control strategies (i) a first control strategy comprising operating at a first reference lambda modified by a first percent kick, and a first rich lambda lag time shorter than a first lean lambda lag time, and (ii) a second control strategy comprising operating at a second reference lambda modified by a second percent kick, and a second rich lag time longer than a second lean lambda lag time, to thereby simultaneously meet predetermined NOx and CO emissions targets.

14 Claims, 5 Drawing Sheets

(56) References Cited

U.S. PATENT DOCUMENTS

| | | | | |
|---|---|---|---|---|
| 2003/0131591 | A1* | 7/2003 | Pott | F01N 3/0814 60/295 |
| 2004/0040282 | A1 | 3/2004 | Zhu | |
| 2004/0187481 | A1* | 9/2004 | Elwart | F01N 13/0093 60/285 |
| 2005/0072138 | A1* | 4/2005 | White | F02D 41/1408 60/285 |
| 2006/0070373 | A1* | 4/2006 | Huang | F01N 3/023 60/286 |
| 2012/0078535 | A1* | 3/2012 | Nakamura | F01N 11/007 702/35 |
| 2016/0290268 | A1* | 10/2016 | Okazaki | F02D 41/222 |
| 2016/0319750 | A1* | 11/2016 | Kayanuma | F02D 41/028 |
| 2018/0023437 | A1* | 1/2018 | Suzuki | F01N 3/18 60/274 |
| 2018/0119630 | A1* | 5/2018 | Kishio | F02D 19/029 |

* cited by examiner

ENGINE LAMBDA DYNAMIC CONTROL STRATEGY FOR EXHAUST EMISSION REDUCTION

FIELD

The present application relates generally to vehicle exhaust emissions and, more particularly, to an engine lambda (air to fuel ratio) control strategy for reduced exhaust emissions.

BACKGROUND

Many vehicles include internal combustion engines that typically produce undesirable exhaust emissions and particles that may, if untreated, be potentially harmful to the environment. These byproducts of the combustion process can include unburnt hydrocarbons (HC), carbon monoxide (CO), nitrogen oxides (NOx), and other particles. Most modern vehicles are equipped with an exhaust system having a catalytic converter which functions to reduce or significantly eliminate such exhaust gas pollutants.

One type of catalytic converter is known as a three-way conversion (TWC) catalyst, which facilitates the oxidation of unburned HC and CO, and the reduction of NOx in the exhaust gas. TWC catalytic converters are designed to have oxygen storage capability to improve their conversion efficiency. In addition, the TWC catalytic converters are designed to be effective over stoichiometric, lean, and rich air-to-fuel ratios (lambda) such that NOx is reduced to N2 when the engine runs lean (oxygen rich) cycles, and CO is oxidized to CO2 when the engine runs rich (oxygen poor) cycles. In this way, the engine lambda is controlled for a given engine operating condition in order to simultaneously meet tailpipe CO and NOx emissions targets. However, due to narrow constraints, it may be difficult to quickly reach target lambda values for those given engine operating conditions. Thus, while current systems do work well for their intended purpose, there remains a need for improvement in the relevant art.

SUMMARY

In one example aspect of the invention, an emissions control system for a vehicle having an exhaust system with an exhaust gas conduit and a catalytic converter configured to receive exhaust gas from an engine is provided. In one example implementation, the system includes an engine controller configured to control the engine to adjust an air to fuel ratio (lambda) thereof, the engine controller further configured to monitor operating parameters of the engine to determine if a given engine operating point is predicted to produce emissions that will not meet a predetermined CO emissions target and/or a predetermined NOx emissions target, upon the given engine operating point being predicted to produce emissions that will not meet the predetermined CO emissions target, operate the engine in a first lambda control strategy comprising operating at a first reference lambda modified by a first percent kick, and a first rich lambda lag time shorter than a first lean lambda lag time, and upon the given engine operating point being predicted to produce emissions that will not meet the predetermined NOx emissions target, operate the engine in a second lambda control strategy comprising operating at a second reference lambda modified by a second percent kick, and a second rich lag time longer than a second lean lambda lag time, to thereby simultaneously meet the predetermined NOx and CO emissions targets at the given engine operating point.

In addition to the foregoing, the described system may include one or more of the following: wherein the engine controller is configured to further operate the engine with a third lambda control strategy comprising operating at a third reference lambda modified by a third percent kick, and a third rich lambda lag time equal to a third lean lambda lag time; wherein the engine controller is configured to operate the engine with a dynamic control strategy comprising the first, second, and third lambda control strategies in order to simultaneously meet the predetermined NOx and CO emissions targets at the given engine operating point; and wherein the first rich lambda lag time and the first lean lambda lag time alternate, the second rich lambda lag time and the second lean lambda lag time alternate, and the third rich lambda lag time and the third lean lambda lag time alternate.

In addition to the foregoing, the described system may include one or more of the following: wherein the first rich lambda lag time is approximately 0.3 seconds and the first lean lambda lag time is approximately 0.5 seconds, the second rich lambda lag time is approximately 0.5 seconds and the second lean lambda lag time is approximately 0.3 seconds, and the third rich lambda lag time is approximately 0.4 seconds and the third lean lambda lag time is approximately 0.4 seconds; wherein at least one of the first, second, and third percent kick is between approximately 40% and approximately 50%; wherein at least one of the first, second, and third percent kick is 45%; and a first oxygen sensor in signal communication with the engine controller, the first oxygen sensor disposed in the exhaust gas conduit upstream of the catalytic converter, and a second oxygen sensor in signal communication with the engine controller, the second oxygen sensor disposed in the exhaust gas conduit downstream of the catalytic converter.

In accordance with another example aspect of the invention, a method of controlling an engine of a vehicle having an exhaust system with an exhaust gas conduit and a catalytic converter configured to receive exhaust gas from the engine is provided. In one example implementation, the method includes monitoring operating parameters of the engine to determine if a given engine operating point is predicted to produce emissions that will not meet a predetermined CO emissions target and/or a predetermined NOx emissions target. Upon the given engine operating point being predicted to produce emissions that will not meet the predetermined CO emissions target, the engine is operated in a first lambda control strategy comprising operating at a first reference lambda modified by a first percent kick, and a first rich lambda lag time shorter than a first lean lambda lag time. Upon the given engine operating point being predicted to produce emissions that will not meet the predetermined NOx emissions target, the engine is in a second lambda control strategy comprising operating at a second reference lambda modified by a second percent kick, and a second rich lag time longer than a second lean lambda lag time, to thereby simultaneously meet the predetermined NOx and CO emissions targets at the given engine operating point.

In addition to the foregoing, the described method may include one or more of the following: controlling the engine with a third lambda control strategy comprising operating at a third reference lambda modified by a third percent kick, and a third rich lambda lag time equal to a third lean lambda lag time; wherein the step of controlling the engine comprises operating the engine with the first, second, and third lambda control strategies in order to simultaneously meet the predetermined NOx and CO emissions targets at the given engine operating point; and wherein operating the engine with the first lambda control strategy further includes alternating the first rich lambda lag time and the first lean lambda lag time, wherein operating the engine with the second lambda control strategy further includes alternating the second rich lambda lag time and the second lean lambda lag time, and wherein operating the engine with the third lambda control strategy further includes alternating the third rich lambda lag time and the third lean lambda lag time.

In addition to the foregoing, the described method may include one or more of the following: wherein the first rich lambda lag time is approximately 0.3 seconds and the first lean lambda lag time is approximately 0.5 seconds, the second rich lambda lag time is approximately 0.5 seconds and the second lean lambda lag time is approximately 0.3 seconds, and the third rich lambda lag time is approximately 0.4 seconds and the third lean lambda lag time is approximately 0.4 seconds; wherein at least one of the first, second, and third percent kick is between approximately 40% and approximately 50%; and wherein at least one of the first, second, and third percent kick is 45%.

An emissions control system for a vehicle having an exhaust system with an exhaust gas conduit and a catalytic converter configured to receive exhaust gas from an engine, the system comprising: an engine controller configured to control the engine to adjust an air to fuel ratio (lambda) thereof, the engine controller configured to operate the engine with a dynamic control strategy that includes the following lambda control strategies: (i) a first control strategy comprising operating at a first reference lambda modified by a first percent kick, and a first rich lambda lag time shorter than a first lean lambda lag time, (ii) a second control strategy comprising operating at a second reference lambda modified by a second percent kick, and a second rich lambda lag time longer than a second lean lambda lag time, and (iii) a third control strategy comprising operating at a third reference lambda modified by a third percent kick, and a third rich lambda lag time equal to a third lean lambda lag time, to thereby simultaneously meet predetermined NOx and CO emissions targets at a given engine operating point.

Further areas of applicability of the teachings of the present application will become apparent from the detailed description, claims and the drawings. It should be understood that the detailed description, including disclosed embodiments and drawings referenced therein, are merely exemplary in nature intended for purposes of illustration only and are not intended to limit the scope of the present application, its application or uses. Thus, variations that do not depart from the gist of the present application are intended to be within the scope of the present application.

DESCRIPTION

The present application is generally directed to systems and methods for reducing engine exhaust emissions from an exhaust system, particularly CO and NOx. The systems utilize asymmetric lambda lag time, for a given percent kick, to produce a lambda map with a wider reference/mean lambda target zone than symmetric lambda lag times. This enables the described systems to simultaneously meet exhaust CO and NOx emissions targets over a greater range of engine lambda operating conditions than what was achievable with only symmetric lambda lag times.

Figure 1:
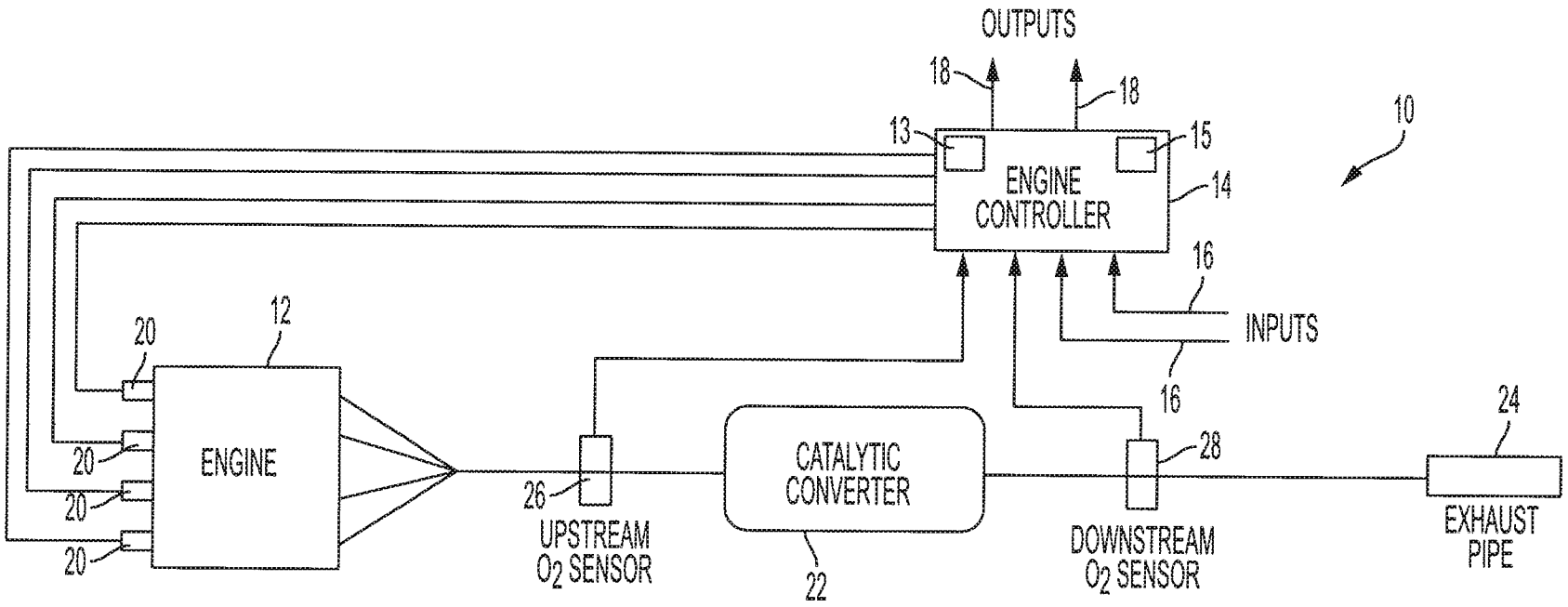
FIG. 1 is a schematic diagram of an example emission control system in accordance with the principles of the present disclosure.

Referring to FIG. 1, an example emission control system for a motor vehicle is generally shown and indicated at reference numeral 10. In the example embodiment, system 10 generally includes an engine 12 in signal communication with an engine controller 14. As used herein, the term controller or module refers to an application specific integrated circuit (ASIC), an electronic circuit, a processor (shared, dedicated, or group) and memory that executes one or more software or firmware programs, a combinational logic circuit, and/or other suitable components that provide the described functionality. In the illustrated example, the engine controller 14 includes a microprocessing unit 13, a memory 15, inputs 16, outputs 18, and communication lines and other hardware and software (not shown) necessary to control the engine 12 and related tasks.

In the example embodiment, the engine controller 14 is configured to maintain a desired air-to-fuel ratio, as well as control other tasks such as spark timing, exhaust gas recirculation, onboard diagnostics, and the like. The emission control system 10 may also include other sensors, transducers, or the like that are in communication with the engine controller 14 through the inputs 16 and outputs 18 to further carry out the operations described herein.

As shown in FIG. 1, in the illustrated example, emission control system 10 further includes one or more fuel injectors 20, which receive a signal from the engine controller 14 to precisely meter an amount of fuel to the engine 12. As a result of the combustion process that takes place in the engine 12, exhaust gases are created and passed out of the engine 12. Some of the constituents of the exhaust gas include hydrocarbons (HC), carbon monoxide (CO), and nitrogen oxides (NOx), which are generally believed to have a potentially detrimental effect on air quality.

The emission control system 10 also includes a catalytic converter 22 for receiving the exhaust gas from the engine 12. In the example embodiment, the catalytic converter is a three-way conversion (TWC) catalyst and contains material that serves as a catalyst to reduce or oxidize the components of the exhaust gas into harmless gases. An exhaust gas conduit 24 is connected to the catalytic converter 22 and is configured to vent the exhaust gas to the atmosphere.

In the example embodiment, first and second oxygen sensors 26, 28 are disposed in the exhaust gas conduit 24 to measure the level of oxygen in the exhaust gas. The first oxygen sensor 26 is disposed upstream of the catalytic converter 22, and the second oxygen sensor 28 is positioned downstream of the catalytic converter 22. As part of the emission control system 10, the oxygen sensors 26, 28 are in signal communication with the engine controller 14.

With additional reference to FIGS. 2 and 3, one example operation of the emission control system 10 will be described. Depending on an engine operating point or condition, the engine 12 is targeted to operate at a specific reference lambda. For example, in FIG. 2, based on various inputs 16 and outputs 18, the engine controller 14 targets engine 12 to operate at a reference lambda represented by line 50. However, engine controller 14 modifies the reference lambda 50 by a certain amount of percent kick 52 (amplitude), over one cycle, to establish a rich kick percent of rich lag 54, and a lean kick percent of lean lag 56, resulting in a modified reference lambda ("modified lambda") operation represented by line 58.

As illustrated, the rich lag 54 and the lean lag 56 are equal (e.g., a duration of 0.4 s), thus creating a symmetrical modified lambda 58. This enables the engine controller 14 to maintain oxygen storage capacity of the catalytic converter 22 such that CO can be oxidized to CO2 when the engine 12 runs rich, and NOx can be reduced to N2 when the engine 12 runs lean. This facilitates the system 10 maintaining both CO and NOx levels by improving the conversion efficiency of the three way catalytic converter 22.

Figure 3:
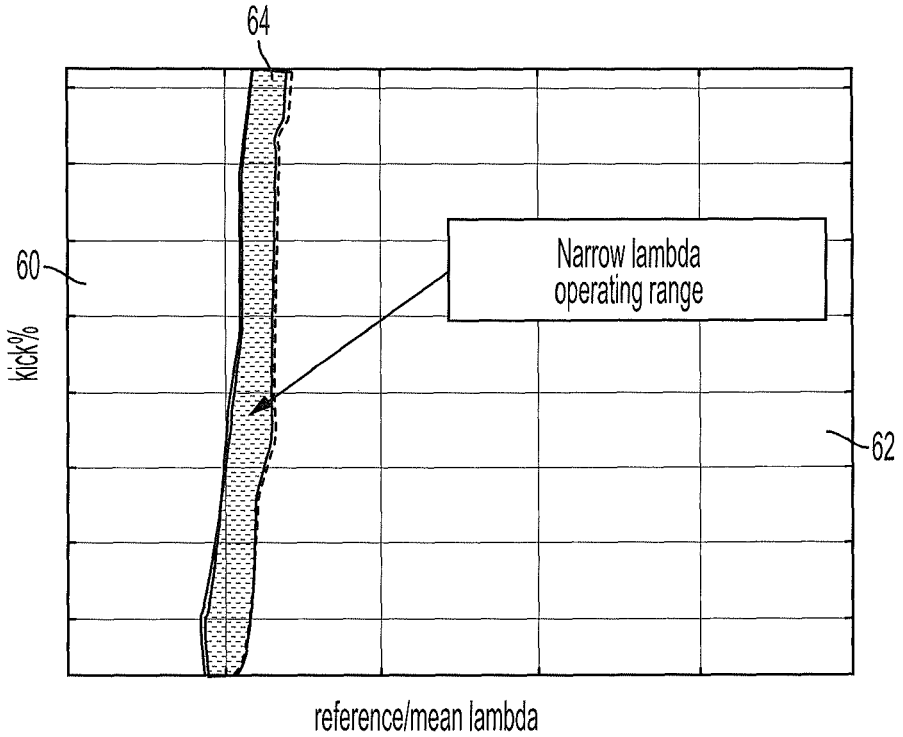
FIG. 3 is a plot of an example lambda map for an engine operating point using the control strategy shown in FIG. 2, in accordance with the principles of the present disclosure.

FIG. 3 illustrates an example lambda map that plots different reference and/or mean lambdas and their percent kicks for a given lag. Such a contour map depicts what lean/rich lag times and percent kick values need to be provided through control for an engine to achieve operation at a given reference/mean lambda and simultaneously meet both NOx and CO emissions targets. In this plot, the x-axis represents reference and/or mean lambda, the y-axis represents percent kick over reference/mean lambda, and the z-axis represents zones where CO and NOx targets, based on gram per mile for each, are or are not met simultaneously.

In the example embodiment, zone 60 illustrates where only NOx targets are met, zone 62 illustrates where only CO targets are met, and the central zone 64 illustrates where both CO and NOx targets are met. As shown, operating system 10 with equal (symmetrical) rich and lean lags times results in a relatively narrow central target zone 64. Thus, under some engine operating conditions, it may be difficult for system 10 to operate the engine 12 at a lambda value within the central target zone 64. Failure to operate the engine 12 at the required lambda defined within the target zone 64 may cause failure to meet emissions targets.

Figure 4:
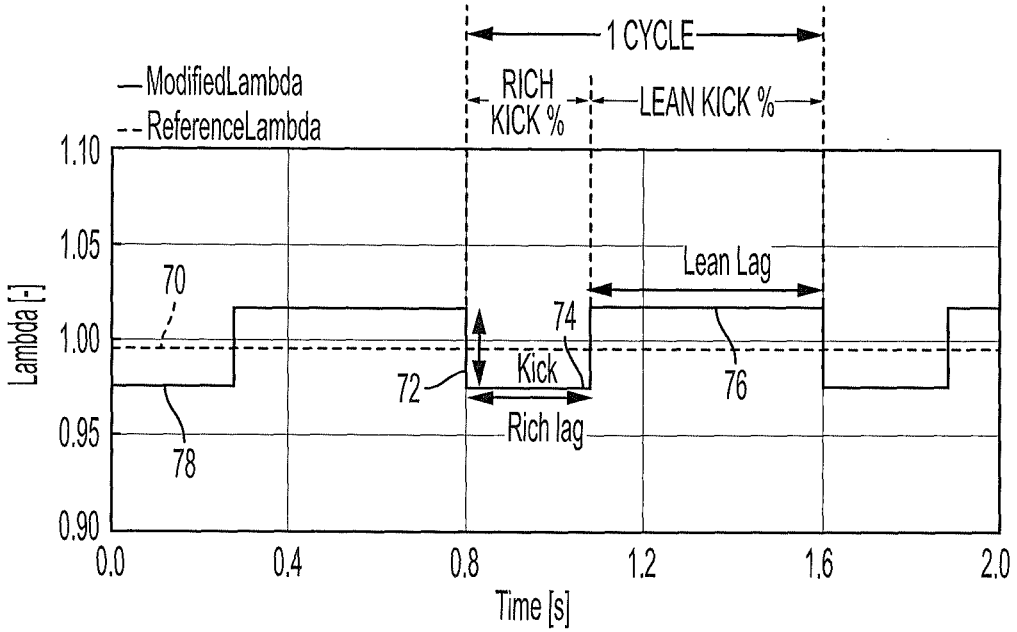
FIG. 4 is a plot of another example control strategy of the emission control system shown in FIG. 1, in accordance with the principles of the present disclosure.
Figure 5:
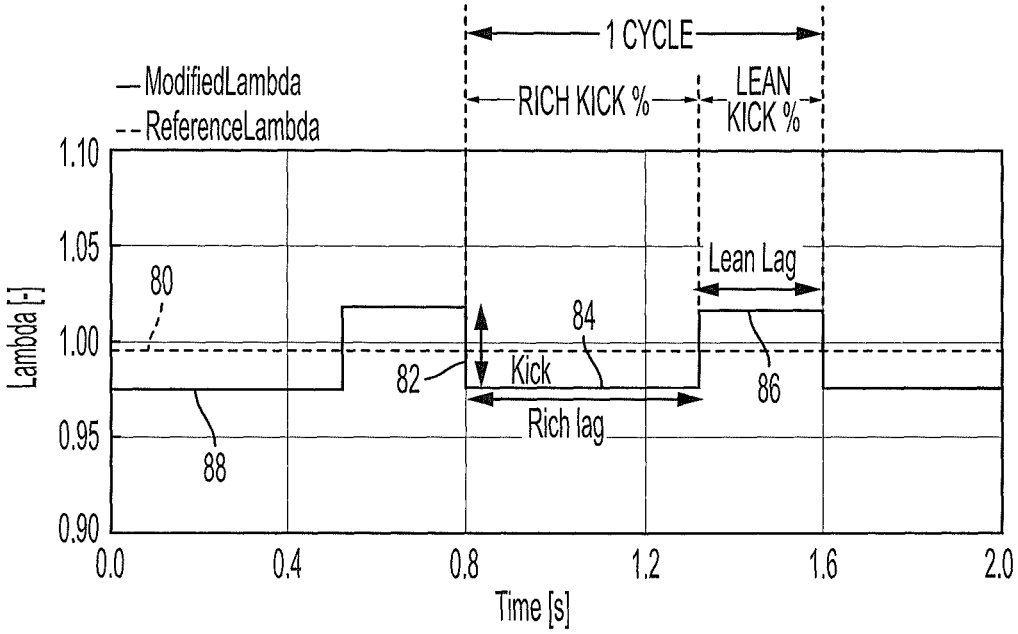
FIG. 5 is a plot of yet another example control strategy of the emission control system shown in FIG. 1, in accordance with the principles of the present disclosure.
Figure 6:
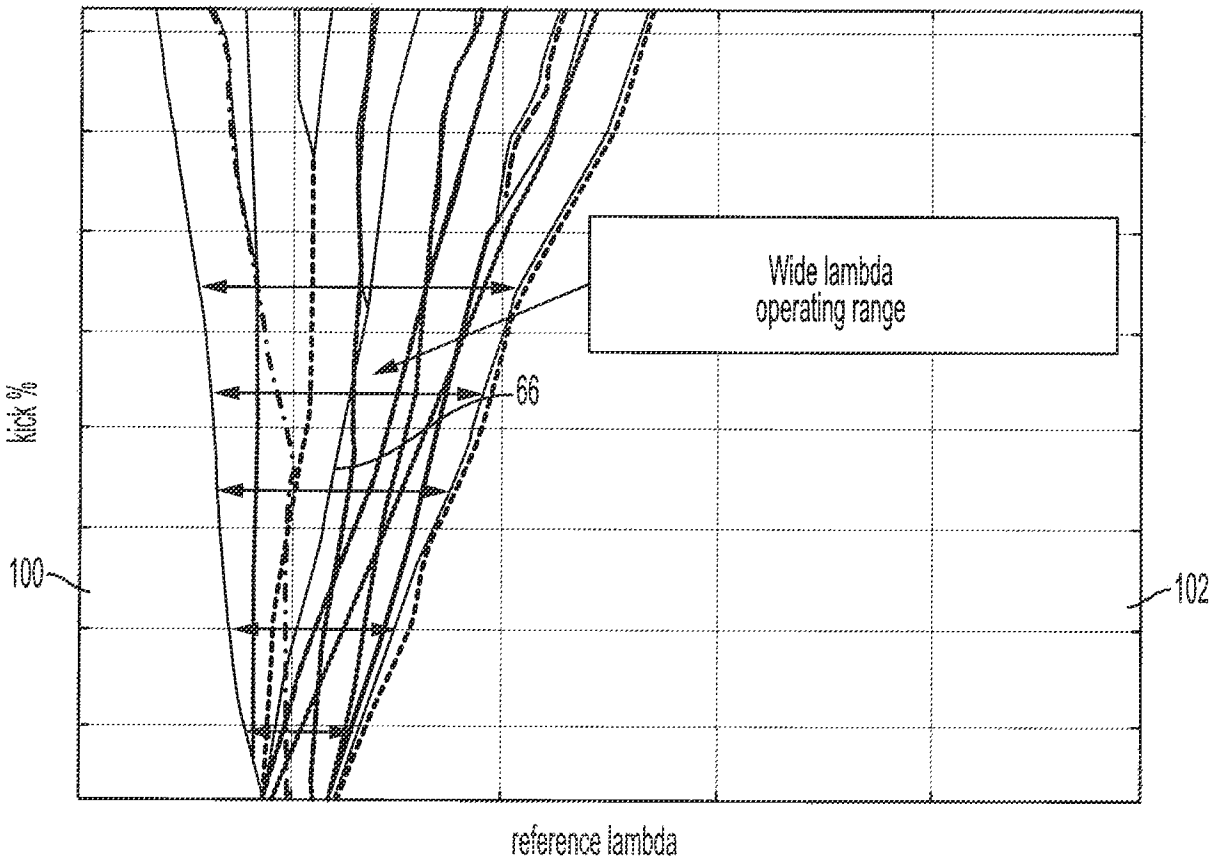
FIG. 6 is a plot of an example lambda map for an engine operating point using a dynamic control strategy that includes the control strategies shown in FIGS. 2, 4, and 5, in accordance with the principles of the present disclosure.

With further reference to FIGS. 4-6, another example operation of the emission control system 10 will be described. In order to widen the central target zone 64 shown in FIG. 3, the engine 12 is targeted to operate with asymmetric lambda lag times, which results in a wider target zone 66 (FIG. 6), as described herein in more detail.

Figure 7:
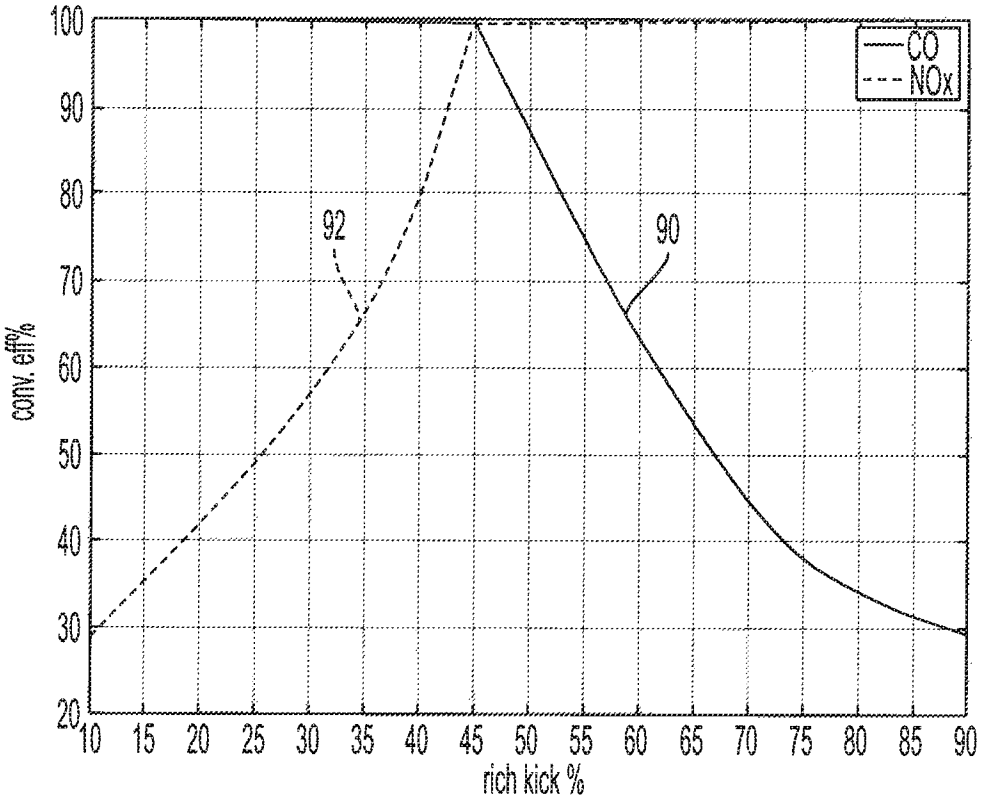
FIG. 7 is a plot of example conversion efficiencies of CO and NOx plotted over a rich kick percentage, in accordance with the principles of the present disclosure.

In a first example shown in FIG. 4, the asymmetric lag times are produced by modifying a reference lambda 70 by a certain amount of percent kick 72 (amplitude), over one cycle, to establish a rich kick percent of a shorter rich lag 74, and a lean kick percent of longer lean lag 76, thereby resulting in a modified lambda operation represented by line 78. As such, the lean lag 76 and rich lag 74 components of modified lambda 78 are unequal and asymmetrical. In the illustrated example, the lean lag 76 duration is 0.5 s or approximately 0.5 s, and the rich lag 74 duration is 0.3 s or approximately 0.3 s. In one example, the percent rich kick 74 is between 40% and 50% or between approximately 40% and approximately 50%. In another example, the percent rich kick 74 is 45% or approximately 45%. Such an example is illustrated in FIG. 7, where the conversion efficiency percentage (y-axis) of CO (line 90) and NOx (line 92) are plotted over rich kick percentage (x-axis).

In a second example shown in FIG. 5, the asymmetric lag times are produced by modifying a reference lambda 80 by a certain amount of percent kick 82 (amplitude), over one cycle, to establish a rich kick percent of a longer rich lag 84, and a lean kick percent of shorter lean lag 86, thereby resulting in a modified lambda operation represented by line 88. As such, the lean lag 86 and rich lag 84 components of modified lambda 88 are unequal and asymmetrical. In the illustrated example, the lean lag 86 duration is 0.3 s or approximately 0.3 s, and the rich lag 84 duration is 0.5 s or approximately 0.5 s. In one example, the percent lean kick 86 is between 40% and 50% or between approximately 40% and approximately 50%. In another example, the percent lean kick 82 is 45% or approximately 45%.

As illustrated in FIGS. 4 and 5, the rich lag time and the lean lag time are unequal and asymmetrical. Similar to the control strategy shown in FIGS. 2 and 3, the control strategy in FIGS. 4 and 5 enables the engine controller 14 to maintain oxygen storage capacity of the catalytic converter 22 such that CO can be oxidized to CO2 when the engine 12 runs rich, and NOx can be reduced to N2 when the engine 12 runs lean. This similarly facilitates system 10 maintaining both CO and NOx levels by improving the conversion efficiency of the three way catalytic converter 22. However, operating the engine 12 with the additional control strategies of FIGS. 4 and 5, with the asymmetrical rich and lean lag times, enables a wider engine operating range while still simultaneously maintaining NOx and CO targets, as shown in FIG. 6.

FIG. 6 illustrates an example lambda map that plots different reference lambdas and their percent kicks for a given lag for one example engine operating point. In the illustrated plot, the x-axis represents reference lambda, the y-axis represents percent kick over reference lambda, and the z-axis represents zones where CO and NOx targets, based on conversion efficiencies for each, are or are not met simultaneously. Zone 100 illustrates where only NOx targets are met, zone 102 illustrates where only CO targets are met, and the central target zone 66 illustrates where both CO and NOx targets are met.

As previously noted, such a contour map depicts what lean/rich lag times and percent kick values need to be provided through control for an engine to achieve operation at a given reference lambda and simultaneously meet both NOx and CO emissions targets.

Figure 2:
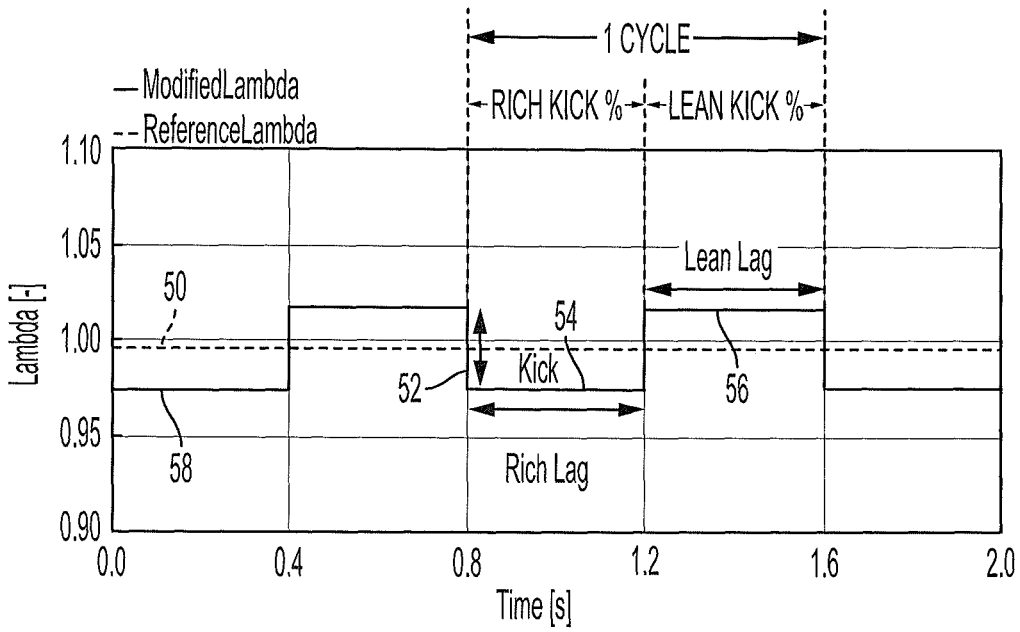
FIG. 2 is a plot of an example control strategy of the emission control system shown in FIG. 1, in accordance with the principles of the present disclosure.

FIG. 6 represents operation with a dynamic control strategy that utilizes a combination of the control strategies shown in FIGS. 2, 4 and 5. Under this dynamic control strategy, the engine controller 14 is not limited to operating at a reference lambda within the narrow operating range (target zone 64) shown in FIG. 3. Rather, with the dynamic control strategy, the engine controller 14 is able to operate the engine 12 under any of the three control strategies, resulting in a wider lambda operating range of engine control points. This provides more engine lambda operating choices and thus makes it easier for the engine 12 to fall within the target zone 66 and simultaneously meet the NOx and CO targets.

Described herein are systems and methods for a dynamic control strategy for operating an engine to simultaneously meet NOx and CO emissions targets. The dynamic control strategy includes operating the engine with a reference lambda modified by a certain amount of percent kick and lean/rich lags in order to control and maintain oxygen storage capacity of a catalytic converter. The dynamic control strategy includes operation between a first control strategy with equal lean and rich lags, a second control strategy with unequal longer lean lags and shorter rich lags, and a third control strategy with unequal shorter lean lags and longer rich lags. Accordingly, the dynamic control strategy provides a wide operation range for reference lambda where NOx and CO targets can be simultaneously met.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. An emissions control system for a vehicle having an exhaust system with an exhaust gas conduit and a catalytic converter configured to receive exhaust gas from an engine, the system comprising:

an engine controller configured to control the engine to adjust an air to fuel ratio (lambda) thereof, the engine controller further configured to:

monitor operating parameters of the engine to determine if a given engine operating point is predicted to produce emissions that will not meet a predetermined CO emissions target and/or a predetermined NOx emissions target;

upon the given engine operating point being predicted to produce emissions that will not meet the predetermined CO emissions target, operate the engine in a first lambda control strategy comprising operating at a first reference lambda modified by a first percent kick amplitude having a first rich lambda lag time shorter than a first lean lambda lag time; and upon the given engine operating point being predicted to produce emissions that will not meet the predetermined NOx emissions target, operate the engine in a second lambda control strategy comprising operating at a second reference lambda modified by a second percent kick amplitude having a second rich lag time longer than a second lean lambda lag time, to thereby simultaneously meet the predetermined NOx and CO emissions targets at the given engine operating point.

2. The system of claim 1, wherein the engine controller is configured to further operate the engine with a third lambda control strategy comprising operating at a third reference lambda modified by a third percent kick amplitude having a third rich lambda lag time equal to a third lean lambda lag time.

3. The system of claim 2, wherein the engine controller is configured to operate the engine with a dynamic control strategy comprising the first, second, and third lambda control strategies in order to simultaneously meet the predetermined NOx and CO emissions targets at the given engine operating point.

4. The system of claim 3, wherein the first rich lambda lag time and the first lean lambda lag time alternate, the second rich lambda lag time and the second lean lambda lag time alternate, and the third rich lambda lag time and the third lean lambda lag time alternate.

5. The system of claim 3, wherein the first rich lambda lag time is 0.3 seconds and the first lean lambda lag time is 0.5 seconds, the second rich lambda lag time is 0.5 seconds and the second lean lambda lag time is 0.3 seconds, and the third rich lambda lag time is 0.4 seconds and the third lean lambda lag time is 0.4 seconds.

6. The system of claim 3, wherein a rich kick percent of the first percent kick amplitude is 45%.

7. The system of claim 1, further comprising:

a first oxygen sensor in signal communication with the engine controller, the first oxygen sensor disposed in the exhaust gas conduit upstream of the catalytic converter; and a second oxygen sensor in signal communication with the engine controller, the second oxygen sensor disposed in the exhaust gas conduit downstream of the catalytic converter.

8. A method of controlling an engine of a vehicle having an exhaust system with an exhaust gas conduit and a catalytic converter configured to receive exhaust gas from the engine, the method comprising:

monitoring operating parameters of the engine to determine if a given engine operating point is predicted to produce emissions that will not meet a predetermined CO emissions target and/or a predetermined NOx emissions target;

upon the given engine operating point being predicted to produce emissions that will not meet the predetermined CO emissions target, operating the engine in a first lambda control strategy comprising operating at a first reference lambda modified by a first percent kick amplitude having a first rich lambda lag time shorter than a first lean lambda lag time; and upon the given engine operating point being predicted to produce emissions that will not meet the predetermined NOx emissions target, operating the engine in a second lambda control strategy comprising operating at a second reference lambda modified by a second percent kick amplitude having a second rich lag time longer than a second lean lambda lag time, to thereby simultaneously meet the predetermined NOx and CO emissions targets at the given engine operating point.

9. The method of claim 8, further comprising controlling the engine with a third lambda control strategy comprising operating at a third reference lambda modified by a third percent kick amplitude having a third rich lambda lag time equal to a third lean lambda lag time.

10. The method of claim 9, wherein the step of controlling the engine comprises operating the engine with the first, second, and third lambda control strategies in order to simultaneously meet the predetermined NOx and CO emissions targets at the given engine operating point.

11. The method of claim 10, wherein operating the engine with the first lambda control strategy further includes alternating the first rich lambda lag time and the first lean lambda lag time, wherein operating the engine with the second lambda control strategy further includes alternating the second rich lambda lag time and the second lean lambda lag time, and wherein operating the engine with the third lambda control strategy further includes alternating the third rich lambda lag time and the third lean lambda lag time.

12. The system of claim 10, wherein the first rich lambda lag time is 0.3 seconds and the first lean lambda lag time is 0.5 seconds, the second rich lambda lag time is 0.5 seconds and the second lean lambda lag time is 0.3 seconds, and the third rich lambda lag time is 0.4 seconds and the third lean lambda lag time is 0.4 seconds.

13. The method of claim 10, wherein a rich kick percent of the first percent kick amplitude is 45%.

14. An emissions control system for a vehicle having an exhaust system with an exhaust gas conduit and a catalytic converter configured to receive exhaust gas from an engine, the system comprising:

an engine controller configured to control the engine to adjust an air to fuel ratio (lambda) thereof, the engine controller configured to operate the engine with a dynamic control strategy that includes the following lambda control strategies:

(i) a first control strategy comprising operating at a first reference lambda modified by a first percent kick amplitude having a first rich lambda lag time shorter than a first lean lambda lag time;

(ii) a second control strategy comprising operating at a second reference lambda modified by a second percent kick amplitude having a second rich lambda lag time longer than a second lean lambda lag time; and (iii) a third control strategy comprising operating at a third reference lambda modified by a third percent kick amplitude having a third rich lambda lag time equal to a third lean lambda lag time, to thereby simultaneously meet predetermined NOx and CO emissions targets at a given engine operating point.

* * * * *